US006378984B1

(12) United States Patent
Steinfield et al.

(10) Patent No.: US 6,378,984 B1
(45) Date of Patent: Apr. 30, 2002

(54) REINFORCING FEATURES IN FLEX CIRCUIT TO PROVIDE IMPROVED PERFORMANCE IN A THERMAL INKJET PRINTHEAD

(75) Inventors: Steven Warren Steinfield; Kirk Edward Novotny, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/127,360

(22) Filed: Jul. 31, 1998

(51) Int. Cl.[7] ..... B41J 2/14
(52) U.S. Cl. ..... 347/47; 347/44; 347/20
(58) Field of Search ..... 347/47, 44, 20, 347/50

(56) References Cited

U.S. PATENT DOCUMENTS

| | | | | | |
|---|---|---|---|---|---|
| 4,313,684 | A | | 2/1982 | Tazaki et al. | 400/322 |
| 4,490,728 | A | | 12/1984 | Vaught et al. | 346/1.1 |
| 4,683,481 | A | | 7/1987 | Johnson | 346/140 R |
| 4,773,971 | A | | 9/1988 | Lam et al. | 204/11 |
| 5,087,930 | A | * | 2/1992 | Roy et al. | 347/22 |
| 5,278,584 | A | | 1/1994 | Keefe et al. | 346/140 R |
| 5,374,948 | A | * | 12/1994 | Saito et al. | 347/47 |
| 5,442,384 | A | | 8/1995 | Schantz et al. | 347/20 |
| 5,450,113 | A | | 9/1995 | Childers et al. | 347/87 |
| 5,467,115 | A | | 11/1995 | Childers | 347/47 |
| 5,568,171 | A | | 10/1996 | Keefe et al. | 347/58 |
| 5,625,396 | A | | 4/1997 | Keefe et al. | 347/84 |
| 5,706,040 | A | | 1/1998 | Reid et al. | 347/50 |
| 5,736,998 | A | | 4/1998 | Caren et al. | 347/45 |
| 5,766,983 | A | | 6/1998 | Reid | 438/107 |
| 6,071,427 | A | * | 6/2000 | Raulinaitis | 347/50 |

* cited by examiner

*Primary Examiner*—John Barlow
*Assistant Examiner*—Manish S. Shah

(57) ABSTRACT

This disclosure describes an improved print cartridge that reduces dimple in the nozzle member and the attendant nozzle trajectory errors. In a preferred embodiment, a nozzle member has a plurality of ink orifices formed therein by suitable processing techniques. A substrate containing a plurality of heating elements and associated ink ejection chambers is affixed to the nozzle member via suitable processing with a suitable adhesive. The heating elements are mounted on a back surface of the nozzle member, each heating element being located proximate to an associated ink ejection chamber and ink orifice, with the back surface of the nozzle member extending over two or more outer edges of the substrate. The nozzle member includes reinforcing features. These features increase the structural integrity of flex circuit in the vicinity of the orifices. The reinforcing features can be of any suitable shape for aiding in stiffening and reducing the long axis curvature of the flex material in the vicinity of the orifices during preprocessing of the flexible circuit. One advantage is that dimple in the nozzle member and the attendant nozzle trajectory errors are reduced.

17 Claims, 12 Drawing Sheets

REINFORCING FEATURES IN FLEX CIRCUIT TO PROVIDE IMPROVED PERFORMANCE IN A THERMAL INKJET PRINTHEAD

FIELD OF THE INVENTION

The present invention generally relates to inkjet and other types of printers and, more particularly, to the printhead portion of an inkjet printer.

BACKGROUND OF THE INVENTION

Inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

inkjet printers print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as a inkjet firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Color inkjet printers commonly employ a plurality of print cartridges, usually either two or four, mounted in the printer carriage to produce a full spectrum of colors. In a printer with four cartridges, each print cartridge contains a different color ink, with the commonly used base colors being cyan, magenta, yellow, and black. In a printer with two cartridges, one cartridge usually contains black ink with the other cartridge being a tri-compartment cartridge containing the base color cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the paper as the printhead is moved relative to the paper. The paper is typically shifted each time the printhead has moved across the paper. The thermal inkjet printer is fast and quiet, as only the ink strikes the paper. These printers produce high quality printing and can be made both compact and affordable.

An inkjet printhead generally includes: (1) ink channels to supply ink from an ink reservoir to each vaporization chamber proximate to an orifice; (2) a metal orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated orifice onto the paper.

In an inkjet printhead described in U.S. Pat. No. 4,683,481 to Johnson, entitled "Thermal Ink Jet Common-Slotted Ink Feed Printhead," ink is fed from an ink reservoir to the various vaporization chambers through an elongated hole formed in the substrate. The ink then flows to a manifold area, formed in a barrier layer between the substrate and a nozzle member, then into a plurality of ink channels, and finally into the various vaporization chambers. This design may be classified as a "center" feed design, whereby ink is fed to the vaporization chambers from a central location then distributed outward into the vaporization chambers. To seal the back of the substrate with respect to an ink reservoir so that ink flows into the center slot but is prevented from flowing around the sides of the substrate in a "center feed" design, a seal is formed, circumscribing the hole in the substrate, between the substrate itself and the ink reservoir body. Typically, this ink seal is accomplished by dispensing an adhesive bead around a fluid channel in the ink reservoir body, and positioning the substrate on the adhesive bead so that the adhesive bead circumscribes the hole formed in the substrate. The adhesive is then cured with a controlled blast of hot air, whereby the hot air heats up the substrate and adhesive, thereby curing the adhesive. This method requires quite a bit of time and thermal energy, since the heat must pass through a relatively thick substrate before heating up the adhesive. Further, because the seal line is under the substrate, it tends to be difficult to diagnose the cause of any ink leakage.

In an inkjet printhead described in U.S. Pat. No. 5,278,584 to Keefe, et al., entitled "Ink Delivery System for an Inkjet Printhead" and U.S. application Ser. No. 08/179,866, filed Jan. 11, 1994 entitled "Improved Ink Delivery System for an Inkjet Printhead," ink flows around the edges of the substrate and directly into ink the channels and then through the ink channels into the vaporization chambers. This "edge feed" design has a number of advantages over previous "center" feed printhead designs. One advantage is that the substrate or die width can be made narrower, due to the absence of the elongated central hole or slot in the substrate. Not only can the substrate be made narrower, but the length of the edge feed substrate can be shorter, for the same number of nozzles, than the center feed substrate due to the substrate structure now being less prone to cracking or breaking without the central ink feed hole. This shortening of the substrate enables a shorter headland and, hence, a shorter print cartridge snout. This is important when the print cartridge is installed in a printer because with a shorter print cartridge snout, the star wheels can be located closer to the pinch rollers to ensure better paper/roller contact along the transport path of the print cartridge snout. There are also a number of performance advantages to the edge feed design.

In U.S. application Ser. No. 07/862,668, filed Apr. 2, 1992, entitled "Integrated Nozzle Member and TAB Circuit for Inkjet Printhead," a novel nozzle member for an inkjet print cartridge and method of forming the nozzle member are disclosed. A flexible tape having conductive traces formed thereon has formed in it nozzles or orifices by Excimer laser ablation. The resulting nozzle member having orifices and conductive traces may then have mounted on it a substrate containing heating elements associated with each of the orifices. The conductive traces formed on the back surface of the nozzle member are then connected to the electrodes on the substrate and provide energization signals for the heating elements. A barrier layer, which may be a separate layer or formed in the nozzle member itself, includes vaporization chambers, surrounding each orifice, and ink flow channels which provide fluid communication between a ink reservoir and the vaporization chambers. By providing the orifices in the flexible circuit itself, the shortcomings of conventional electroformed orifice plates are overcome. Additionally, the orifices may be formed aligned with the conductive traces on the nozzle member so that alignment of electrodes on a substrate with respect to ends of the conductive traces also aligns the heating elements with the orifices. This integrated nozzle and tab circuit design is superior to the orifice plates for inkjet printheads formed of nickel and fabricated by lithographic electroforming processes as described in U.S. Pat. No. 4,773,971, entitled "Thin Film Mandrel". Such orifice plates for inkjet printheads have several shortcomings such as requiring delicate balancing of parameters such as stress and plating thicknesses, disc diameters, and overplating ratios; inherently limiting the design choices for nozzle shapes and sizes; de-lamination of the orifice plate from the substrate and corrosion by ink.

In U.S. application Ser. No. 07/864,896, filed Apr. 2, 1992, entitled "Adhesive Seal for an Inkjet Printhead," a procedure for sealing an integrated nozzle and tab circuit to a print cartridge is disclosed. A nozzle member containing an array of orifices has a substrate, having heater elements formed thereon, affixed to a back surface of the nozzle member. Each orifice in the nozzle member is associated with a single heating element formed on the substrate. The back surface of the nozzle member extends beyond the outer edges of the substrate. Ink is supplied from an ink reservoir to the orifices by a fluid channel within a barrier layer between the nozzle member and the substrate. The fluid channel in the barrier layer may receive ink flowing around two or more outer edges of the substrate ("edge feed") or, in another embodiment, may receive ink which flows through a hole in the center of the substrate ("center feed"). In either embodiment, the nozzle member is adhesively sealed with respect to the ink reservoir body by forming an ink seal, circumscribing the substrate, between the back surface of the nozzle member and the body.

This method and structure of providing a seal directly between a nozzle member and an ink reservoir body has many advantages over prior art methods of providing a seal between the back surface of the substrate and the ink reservoir body. One advantage is that such a seal makes an edge ink-feed design possible. Another advantage is that, in an embodiment where the nozzle member has conductive traces formed on its bottom surface for contact to electrodes on the substrate, the adhesive seal acts to encapsulate and protect the traces near the substrate which may come in contact with ink. Additionally, since the sealant is also an adhesive, the nozzle member is directly secured to the ink reservoir body, thus forming a stronger bond between the printhead and the inkjet print cartridge. Further, it is much easier to detect leaks in the sealant, since the sealant line is more readily observable. Another advantage is that it takes less time to cure the adhesive seal, since only a thin nozzle member is between the sealant and the heat source used for curing the sealant.

However, during manufacturing, the headland design of previous print cartridges had several disadvantages, including difficulty in controlling the edge seal to the die or substrate without having adhesive getting into the nozzle and clogging them, or on the other hand, voids of adhesive in the tab bond window. It was also very difficult to control the adhesive bulge through the window caused by excess adhesive, or varying die placement. All of these problems result in extremely high yield losses when manufacturing thermal inkjet print cartridges. In U.S. application Ser. No. 08/398,849, filed Mar. 6, 1995, entitled "Inkjet Cartridge Design for Facilitating the Adhesive Sealing of a Printhead to an Ink Reservoir" an improved headland design is disclosed which alleviates the above-mentioned problems.

However, the above designs did not address the problem of "dimpling" being formed in the nozzle member caused by bending of the nozzle member due to the stresses created by the adhesive process of sealing the nozzle member to the print cartridge. This dimpling of the nozzle member creates poor nozzle camber angle (NCA), thereby skewing the nozzles, which causes trajectory errors for the ejected ink droplets from the nozzles. When the TAB head assembly is scanned across a recording medium the ink trajectory errors will affect the location of printed dots and, thus, affect the quality and/or speed of printing.

One method of reducing this problem is using an articulated flex. This involves using laser ablation to remove material from the flex circuit in order to increase flexibility along a crease parallel to the firing chamber array. The disadvantage of this method is that structural integrity of printhead assembly in vicinity of firing chambers is reduced. Also, costs are increased due to the additional and/or modified laser ablation steps. Another method is "windowframing", which involves bonding THA to a stiff frame for maintaining the flex circuit in tension. This method has several problems, namely additional part and processes are required, the amount of tension required to affect the NCA causes delamination of the flex circuit and the barrier layer and this method requires electrical isolation from copper traces on flex circuit. Yet another method includes using a diamond light coating (DLC). The DLC method involves applying a hard coating to one or both sides of the flex circuit. However, this method has increased costs, causes cracking of the coating and provides minimal effectiveness on NCA.

Accordingly, it would be advantageous to have an improved print cartridge that reduces dimple in the nozzle member and the attendant nozzle trajectory errors.

SUMMARY OF THE INVENTION

The present invention provides an improved method and design for a printing system and print cartridge for reducing dimpling in the nozzle member and attendant nozzle trajectory errors. In a preferred embodiment, a nozzle member has a plurality of ink orifices formed therein by suitable processing techniques. A substrate containing a plurality of heating elements and associated ink ejection chambers is affixed to the nozzle member via suitable processing with a suitable adhesive. The heating elements are mounted on a back surface of the nozzle member, each heating element being located proximate to an associated ink ejection chamber and ink orifice, with the back surface of the nozzle member extending over two or more outer edges of the substrate. The nozzle member includes reinforcing features. These features increase the structural integrity of flex circuit in the vicinity of the orifices. The reinforcing features can be of any suitable shape for aiding in maintaining plastic deformation of the flex material in the vicinity of the orifices during preprocessing of the flexible circuit.

The invention further includes a method for creating the reinforcing features by selectively embossing the flex circuit either before, after, or during the creation of the orifices of the nozzle member.

BRIEF DESCRIPTION OF THE DRAWINGS

The present invention can be further understood by reference to the following description and attached drawings which illustrate the preferred embodiment.

Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

Introduction

Figure 1:
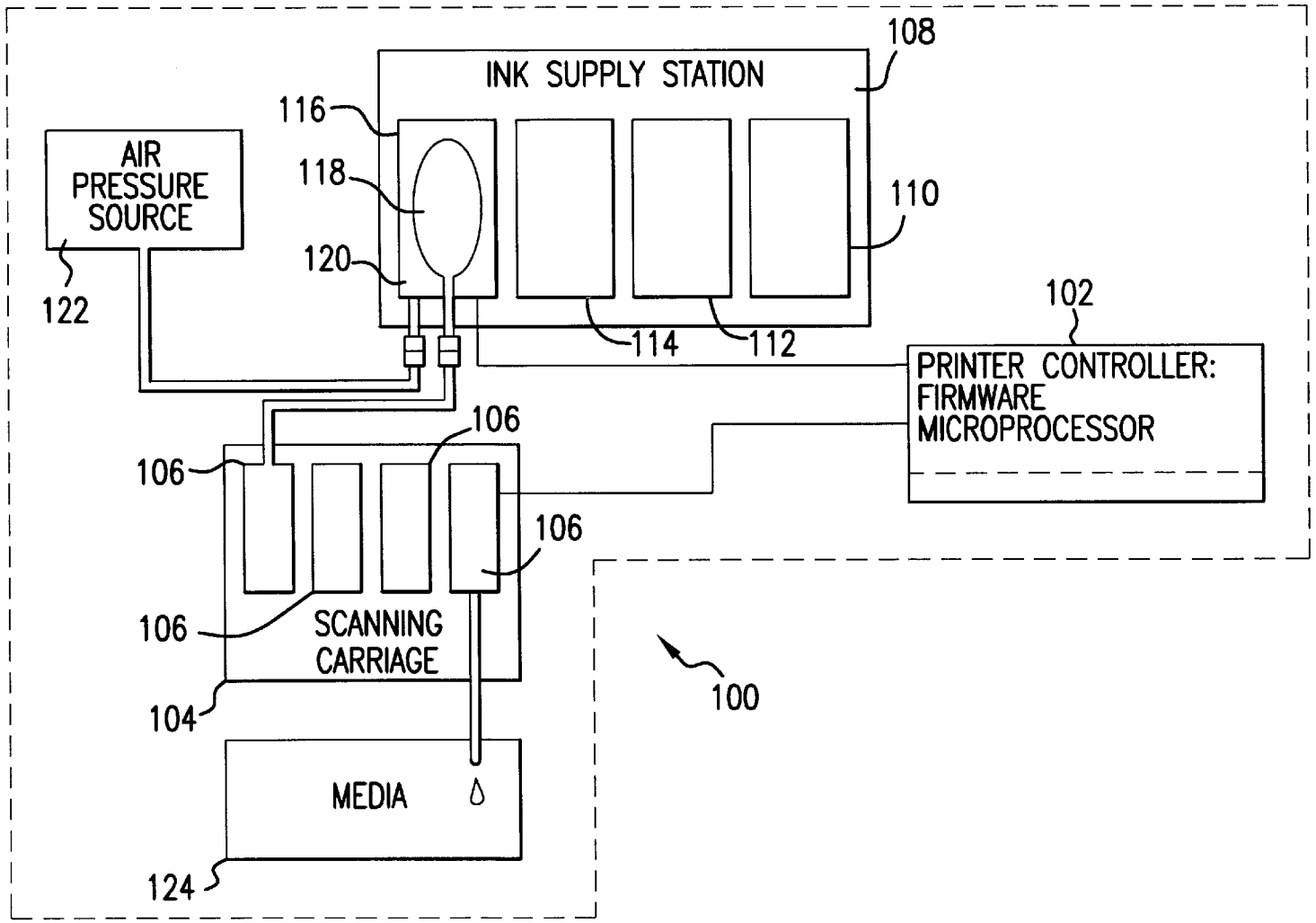
FIG. 1 shows a block diagram of an overall printing system incorporating the present invention.

FIG. 1 shows a block diagram of an overall printing system 100 incorporating the present invention. A printer controller 102 controls the printer operations in accordance with signals it receives from a computer (not shown). A scanning carriage 104 holds a plurality of high performance print cartridges 106 that are fluidically coupled to an ink supply station 108. The supply station provides pressurized ink to the print cartridges 106. Each cartridge has a regulator valve that opens and closes to maintain a slight negative gauge pressure in the cartridge that is optimal for printhead performance. The ink may be pressurized to eliminate effects of dynamic pressure drops associated with high throughput printing. The ink supply station 108 contains receptacles or bays for slidable mounting ink containers 110–116. Each ink container has a collapsible ink reservoir, such as reservoir 118 that is surrounded by an air pressure chamber 120. An air pressure source or pump 122 is in communication with the air pressure chamber 120 for pressurizing the collapsible reservoir 118. Pressurized ink is then delivered to the print cartridge, e.g. cartridge 106, by an ink flow path. One air pump supplies pressurized air for all ink containers in the system. In an exemplary embodiment, the pump supplies a positive pressure of 2 psi, in order to meet ink flow rates on the order of 25 cc/min. For systems having lower ink flow rate requirement, a lower pressure will suffice, and some cases with low throughput rates will require no positive air pressure at all. While the present invention will be described below in the context of an off-axis printer having an external ink source, it should be apparent that the present invention is also useful in other inkjet printers which use inkjet print cartridges having ink reservoirs that are integral with the print cartridge.

Figure 2:
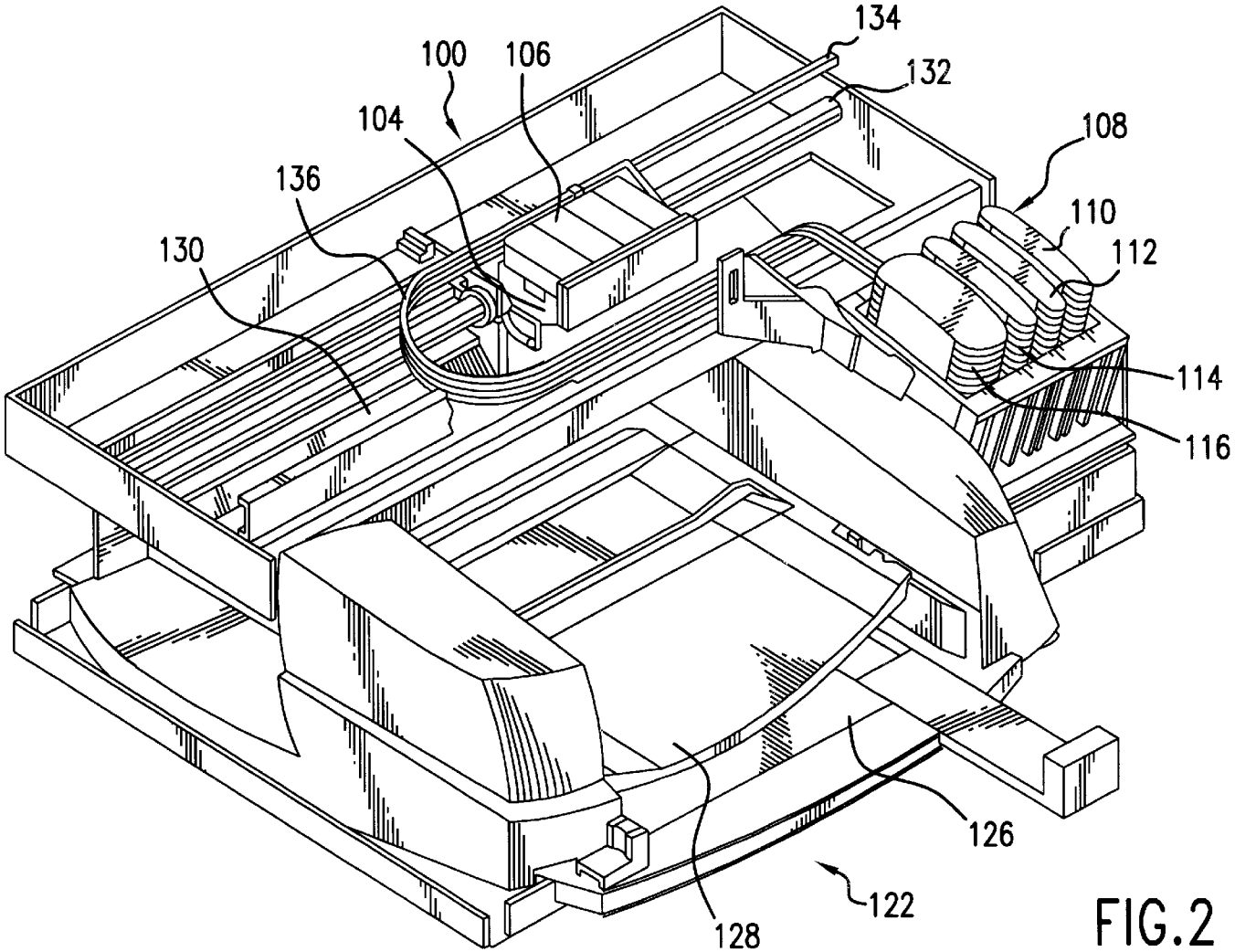
FIG. 2 is a perspective view of one embodiment of an inkjet printer utilizing a print cartridge with a Tape Automated Bonding (TAB) printhead assembly of the present invention.

FIG. 2 is a perspective view of an exemplary inkjet printer utilizing a print cartridge with a Tape Automated Bonding (TAB) printhead assembly of the present invention shown for illustrative purposes only. Generally, printing system 100, such as a printer, includes a tray 122 for holding media 124 (shown in FIG. 1). When a printing operation is initiated, a sheet of media from tray 126 is fed into printer 100 using a sheet feeder, then preferably brought around in a U direction to now travel in the opposite direction toward tray 128. Other paper paths, such as a straight paper path, can also be used. The sheet is stopped in a print zone 130, and a scanning carriage 104, supporting one or more print cartridges 106, is then scanned across the sheet for printing a swath of ink thereon. After a single scan or multiple scans, the sheet is then incrementally shifted using a conventional stepper motor and feed rollers to a next position within the print zone 130, and carriage 104 again scans across the sheet for printing a next swath of ink. When the printing on the sheet is complete, the sheet is forwarded to a position above tray 128, held in that position to ensure the ink is dry, and then released. The carriage 104 scanning mechanism may be conventional and generally includes a slide rod 132, along which carriage 106 slides, a flexible circuit (not shown in FIG. 2) for transmitting electrical signals from the printer's microprocessor to the carriage 104 and print cartridges 106 and a coded strip 134 which is optically detected by a photo detector in carriage 104 for precisely positioning carriage 104. A stepper motor (not shown), connected to carriage 104 using a conventional drive belt and pulley arrangement, is used for transporting carriage 104 across print zone 130. The features of inkjet printer 100 include an ink delivery system for providing ink to the print cartridges 106 and ultimately to the ink ejection chambers in the printheads from an off-axis ink supply station 108 containing replaceable ink supply cartridges 110, 112, 114, and 116, releasably mounted in an ink supply station 108 and which may be pressurized or at atmospheric pressure. For color printers, there will typically be a separate ink supply cartridge for black ink, yellow ink, magenta ink, and cyan ink. Four tubes 136 carry ink from the four replaceable ink supply cartridges 110–116 to the print cartridges 106.

Figure 3:
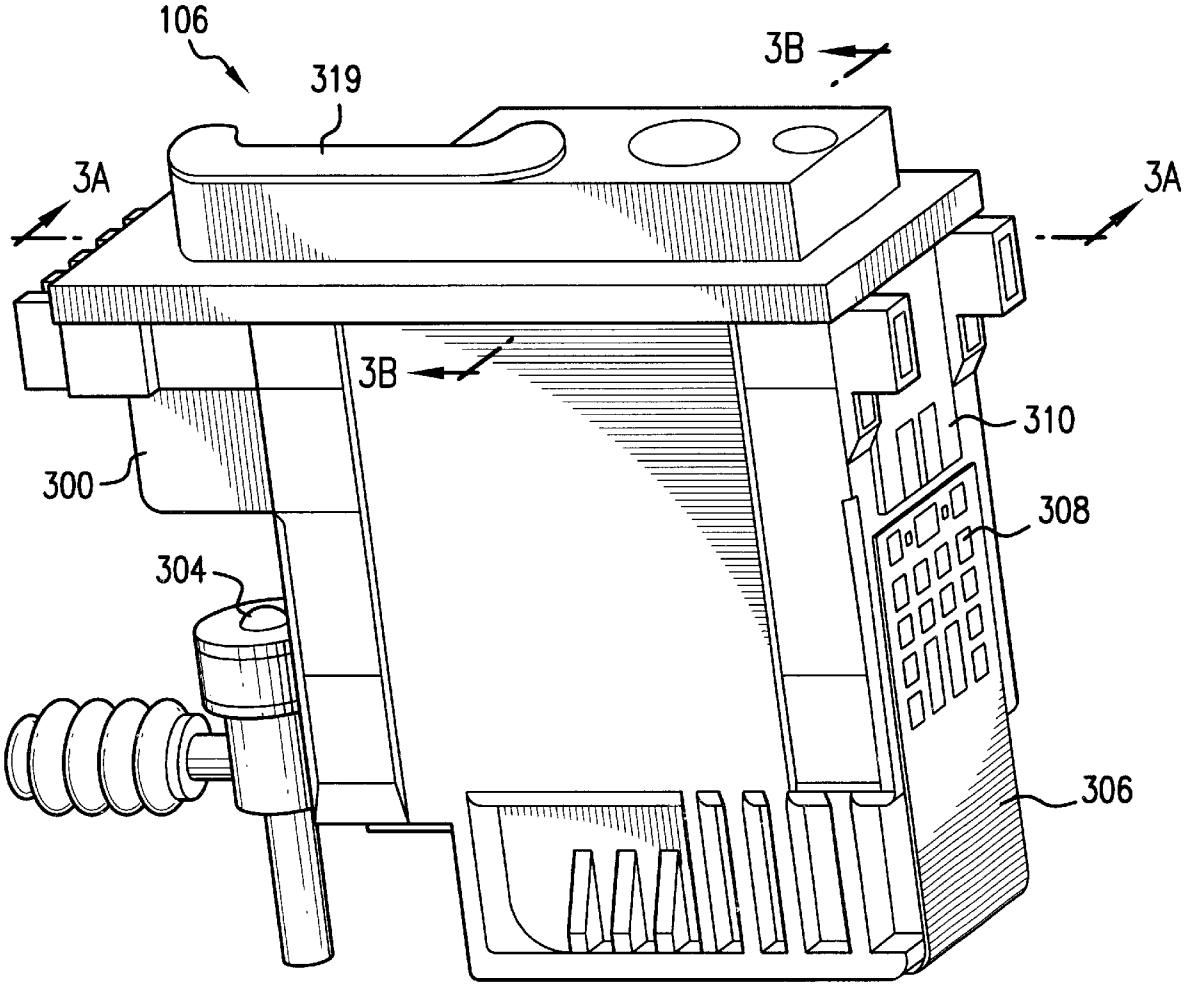
FIG. 3 is a perspective view of one embodiment of a print cartridge utilizing the TAB head assembly of the present invention.

FIG. 3 is a perspective view of an exemplary print cartridge utilizing the TAB head assembly of the present invention shown for illustrative purposes only. A shroud 300 surrounds needle 302 (obscured by shroud 300 in FIG. 3, but shown in FIG. 4) to prevent inadvertent contact with needle 302 and also to help align septum 304 with needle 302 when installing print cartridge 106 in carriage 104. A flexible tape 306, such as a Tape Automated Bonding (TAB) printhead assembly, containing contact pads 308 leading to the printhead substrate is secured to print cartridge 106. The flexible tape 306 (TAB head assembly) and its novel reinforcing features will be discussed below in detail. An integrated circuit chip 310 provides feedback to the printer regarding certain parameters of print cartridge 106. These contact pads 308 align with and electrically contact electrodes (not shown) on carriage 104. Preferably, the electrodes on carriage 104 are resiliently biased toward print cartridge 106 to ensure a reliable contact. Such carriage electrodes are found in U.S. Pat. No. 5,408,746, entitled Datum Formation for Improved Alignment of Multiple Nozzle Members in a Printer assigned to the present assignee and incorporated herein by reference.

Figure 4:
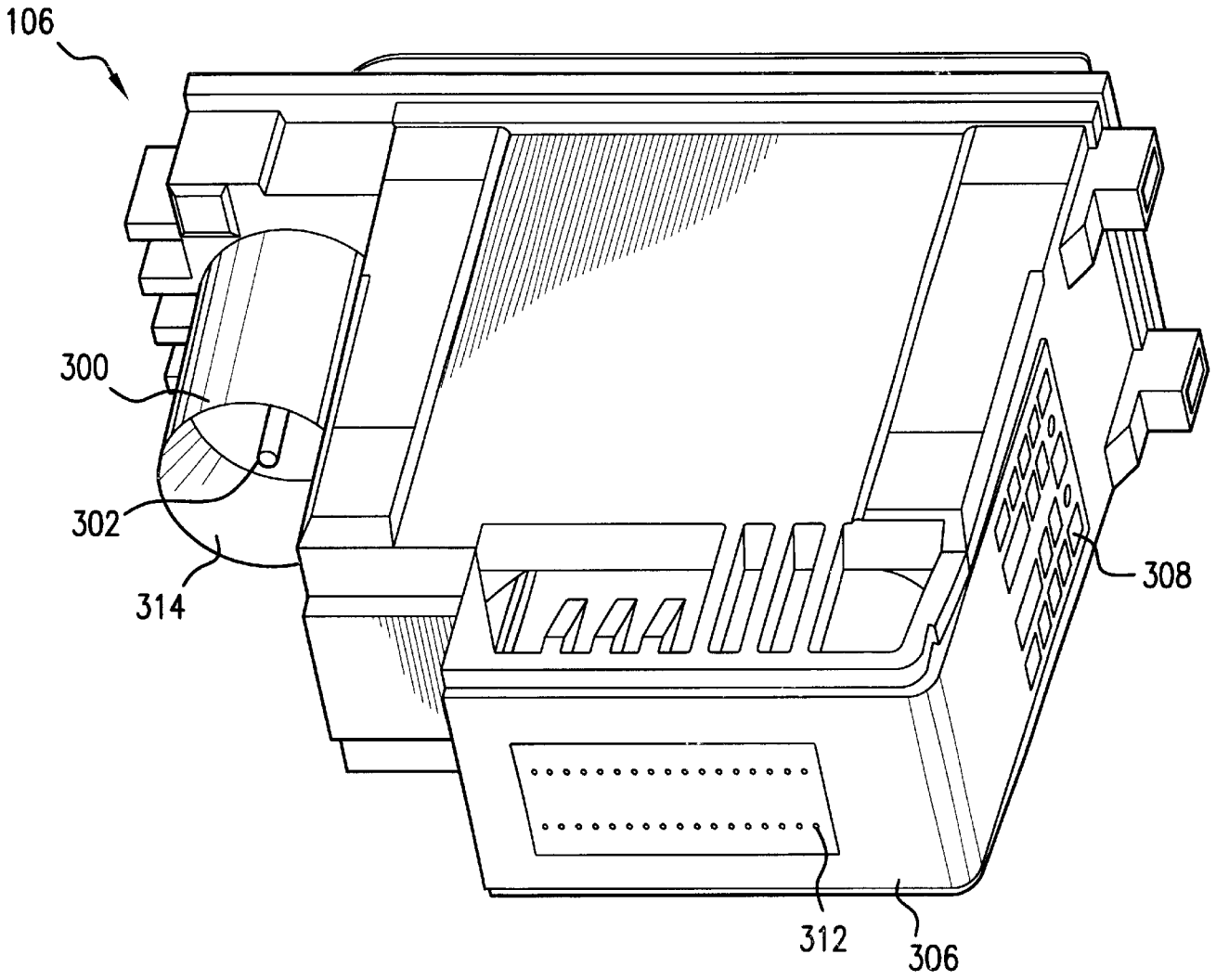
FIG. 4 shows the bottom side of the print cartridge of FIG. 3.
Figure 5:
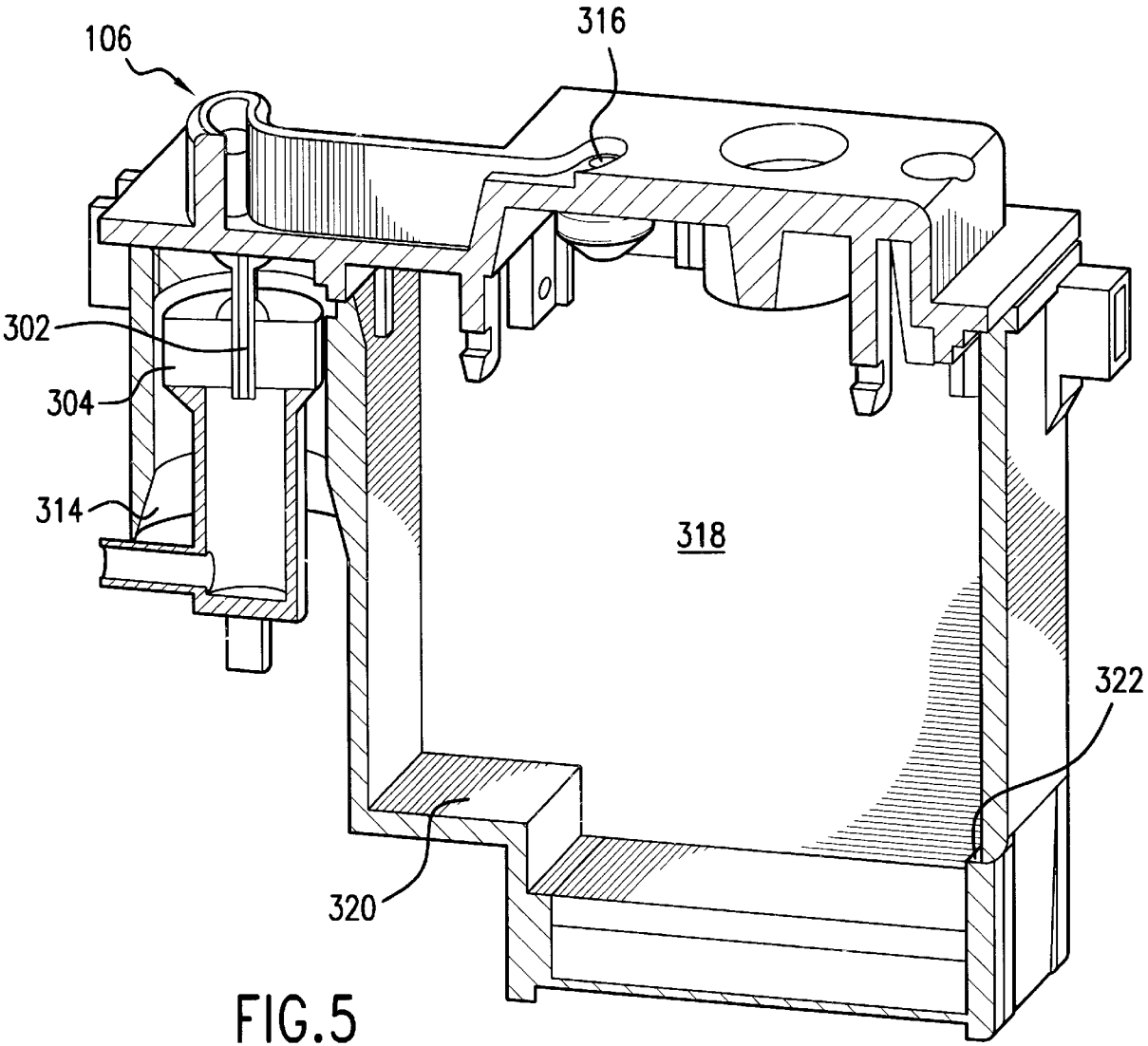
FIG. 5 is a cross-sectional view of the print cartridge of FIG. 3, without the tape of the TAB head assembly, taken along line 3A—3A in FIG. 3.

FIG. 4 shows the bottom side of the print cartridge of FIG. 3. There are preferably two parallel rows of offset nozzles 312 through the tape 306 created by, for example, laser ablation. Also, the tape 306 has reinforcing features (shown in detail in FIGS. 10 and 11 below with an exemplary print cartridge). FIG. 5 is a cross-sectional view of the print cartridge of FIG. 3, without the tape of the TAB head assembly, taken along line 3A—3A in FIG. 3. Shroud 300 is shown having an inner conical or tapered portion 314 to receive septum 304 and center septum 304 with respect to needle 302. A valve (not shown) within print cartridges 106 regulates pressure by opening and closing an inlet hole 316 to ink chamber internal to print cartridges 106. The ink valve is automatically opened and closed by an internal ink pressure regulator which senses the pressure difference between the ambient pressure and the pressure internal to the ink chamber, so as to maintain a relatively constant negative pressure within the ink chamber. This negative pressure prevents ink drooling from nozzles 312. For a detailed description of the design and operation of the regulator see U.S. patent application Ser. No. 08/706121, filed Aug. 30, 1996, entitled "Inkjet Printing System with Off-Axis Ink Supply Having Ink Path Which Does Not Extend above Print Cartridge," and U.S. application Ser. No. 08/550,902, filed Aug. 30, 1996, entitled "Printer Using Print Cartridge with Internal Pressure Regulator," which are herein incorporated by reference. When the regulator valve is opened, the needle 302, such as a hollow needle, is in fluid communication with an ink chamber 318 internal to the cartridge 106. The needle 302 extends through a self-sealing hole formed in through the center of the septum 304. The hole is automatically sealed by the resiliency of the rubber septum 304 when the needle is removed. A plastic conduit 319 leads from the needle 302 to chamber 318 via the hole 316. The conduit 319 may be glued, heat-staked, ultrasonically welded or otherwise secured to the print cartridge body. The conduit may also be integral to the print cartridge body. Surfaces 320, 322 support a filter carrier, which will be described below. Referring to FIG. 4, conductors (not shown) are formed on the back of tape 306 and terminate in contact pads 308 for contacting electrodes on carriage 104. The other ends of conductors are bonded to terminals or electrodes (not shown) of a substrate (not shown) on which are formed the various ink ejection chambers and ink ejection elements. The ink ejection elements may be heater resistors or piezoelectric elements.

Exemplary Print Cartridge

Figure 6:
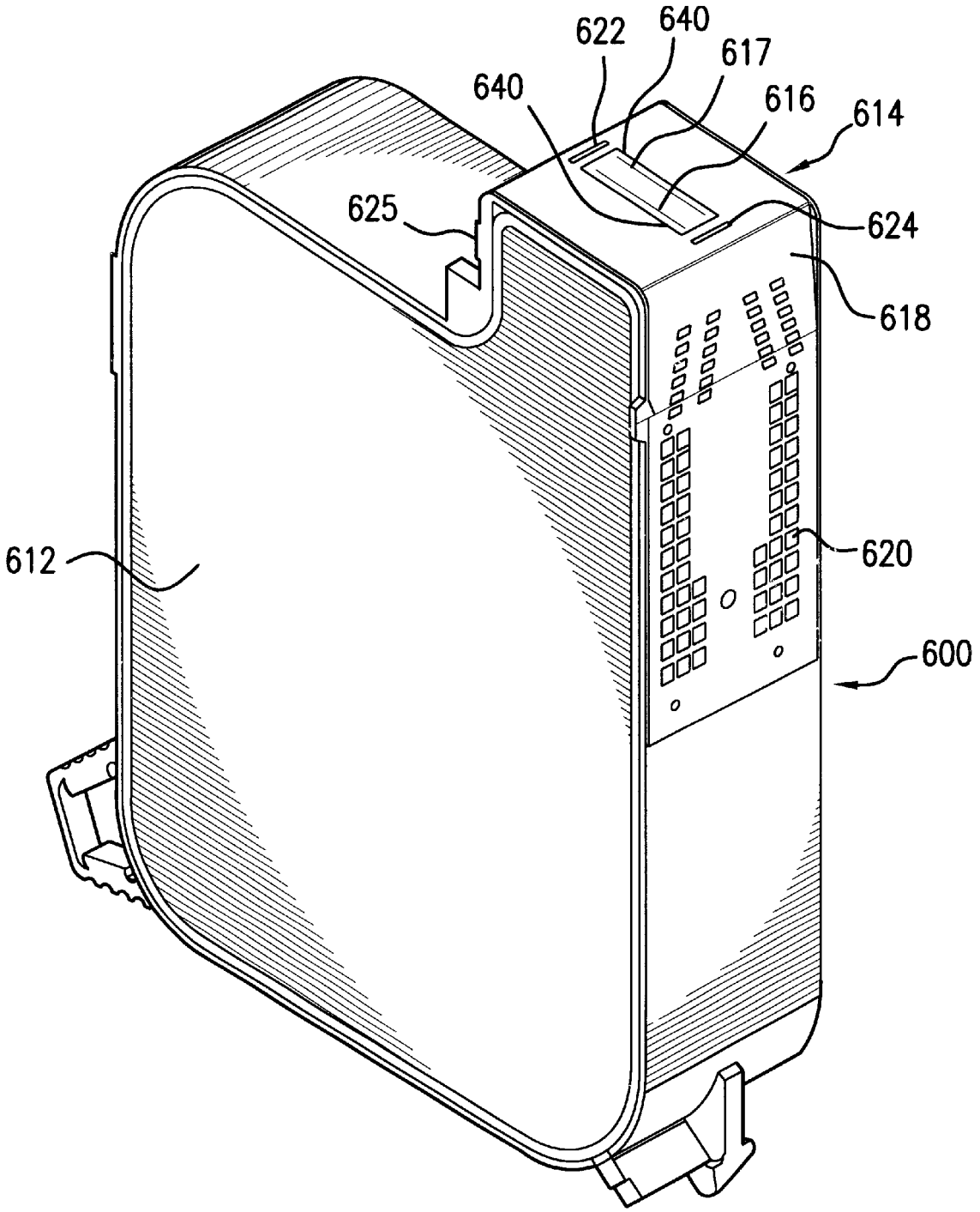
FIG. 6 is a perspective view of another inkjet printhead utilizing the TAB head assembly of the present invention.

Referring to FIG. 6, reference numeral 600 generally indicates an inkjet print cartridge incorporating a printhead according to one embodiment of the present invention shown for simplified illustrative purposes only. The inkjet print cartridge 600 includes an ink reservoir 612 and a printhead 614, where the printhead 614 is formed using Tape Automated Bonding (TAB). The printhead 614 (hereinafter "TAB head assembly 614" similar to the TAB assembly discussed above) includes a nozzle member 616 comprising two parallel columns of offset holes or orifices 617 formed by, for example, laser ablation, in a flexible polymer circuit 618, or flex tape, similar to the flex tape 306 discussed above.

A back surface of the flexible circuit 618 includes conductive traces 636 (shown in FIG. 7) formed thereon using a conventional photolithographic etching and/or plating process. These conductive traces 636 are terminated by large contact pads 620 designed to interconnect with a printer. The print cartridge 600 is designed to be installed in a printer so that the contact pads 620, on the front surface of the flexible circuit 618, contact printer electrodes providing externally generated energization signals to the printhead.

Windows 622 and 624 extend through the flexible circuit 618 and are used to facilitate bonding of the other ends of the conductive traces 636 to electrodes on a silicon substrate containing heater resistors. The windows 622 and 624 are filled with an encapsulant to protect any underlying portion of the traces and substrate.

In the print cartridge 600 of FIG. 6, the flexible circuit 618 is bent over the back edge of the print cartridge "snout" and extends approximately one half the length of the back wall 625 of the snout. This flap portion of the flexible circuit 618 is needed for the routing of conductive traces 636, which are connected to the substrate electrodes through the far end window 622. The contact pads 620 are located on the flexible circuit 618 which is secured to this wall and the conductive traces 636 are routed over the bend and are connected to the substrate electrodes through the windows 622, 624 in the flexible circuit 618.

Figure 7:
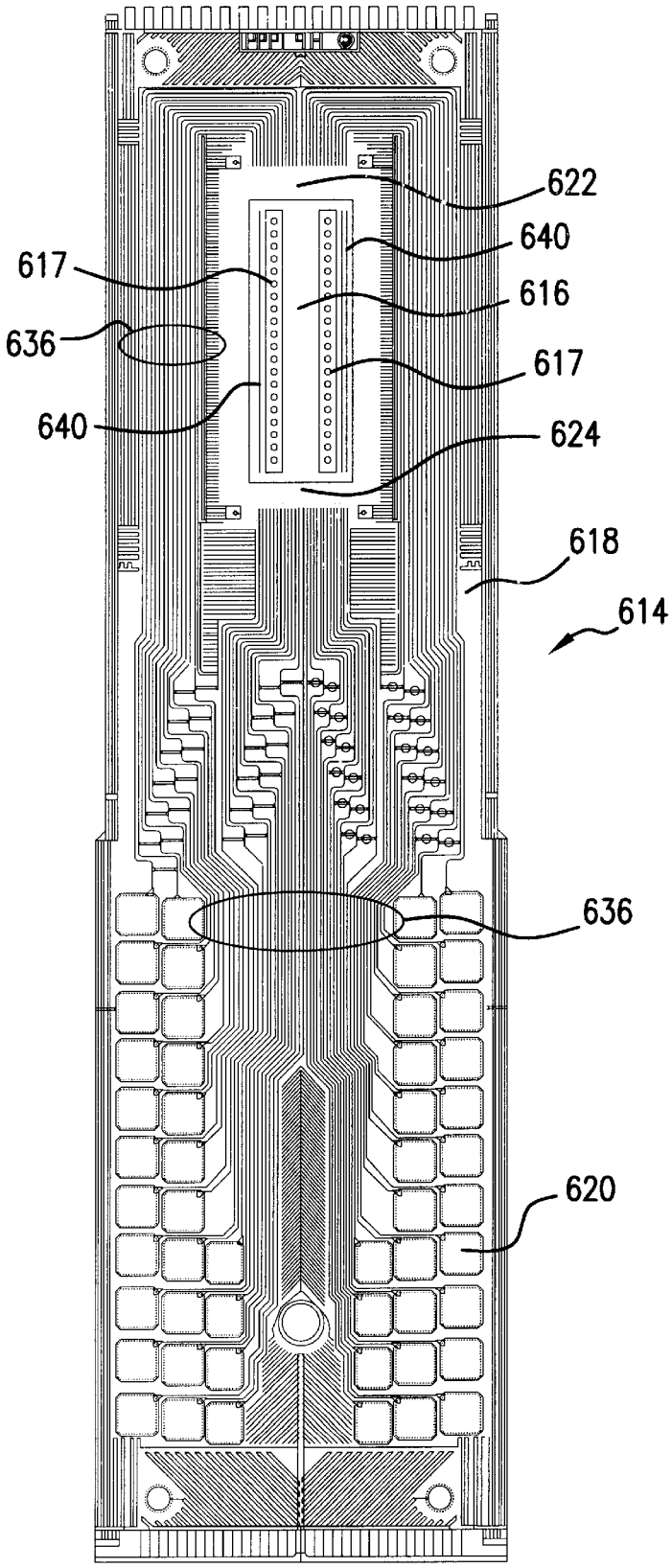
FIG. 7 is a perspective view of the front surface of the TAB head assembly removed from the print cartridge of FIG. 6.
Figure 8:
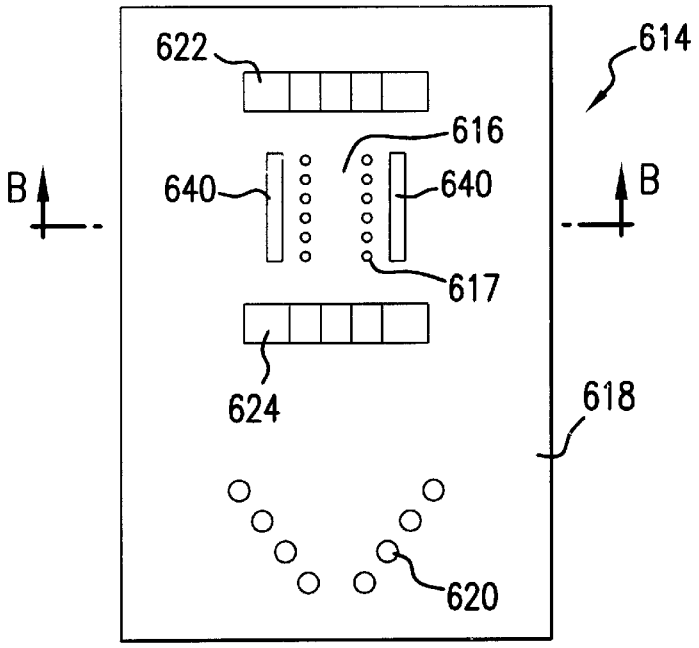
FIG. 8 is a top view of the front surface of the TAB head assembly removed from the simplified schematic print cartridge of FIG. 7.

FIG. 7 shows a front view of electrical details of the TAB head assembly 614 of FIG. 6 removed from the print cartridge 600 and prior to windows 622 and 624 in the TAB head assembly 614 being filled with an encapsulant. FIG. 8 is a simplified top view showing the mechanical features of the front surface of the TAB head assembly of FIG. 6. TAB head assembly 614 has affixed to the back of the flexible circuit 618 a silicon substrate (not shown) containing a plurality of individually energizable thin film resistors. Each resistor is located generally behind a single orifice 617 and acts as an ohmic heater when selectively energized by one or more pulses applied sequentially or simultaneously to one or more of the contact pads 620.

Figure 12:
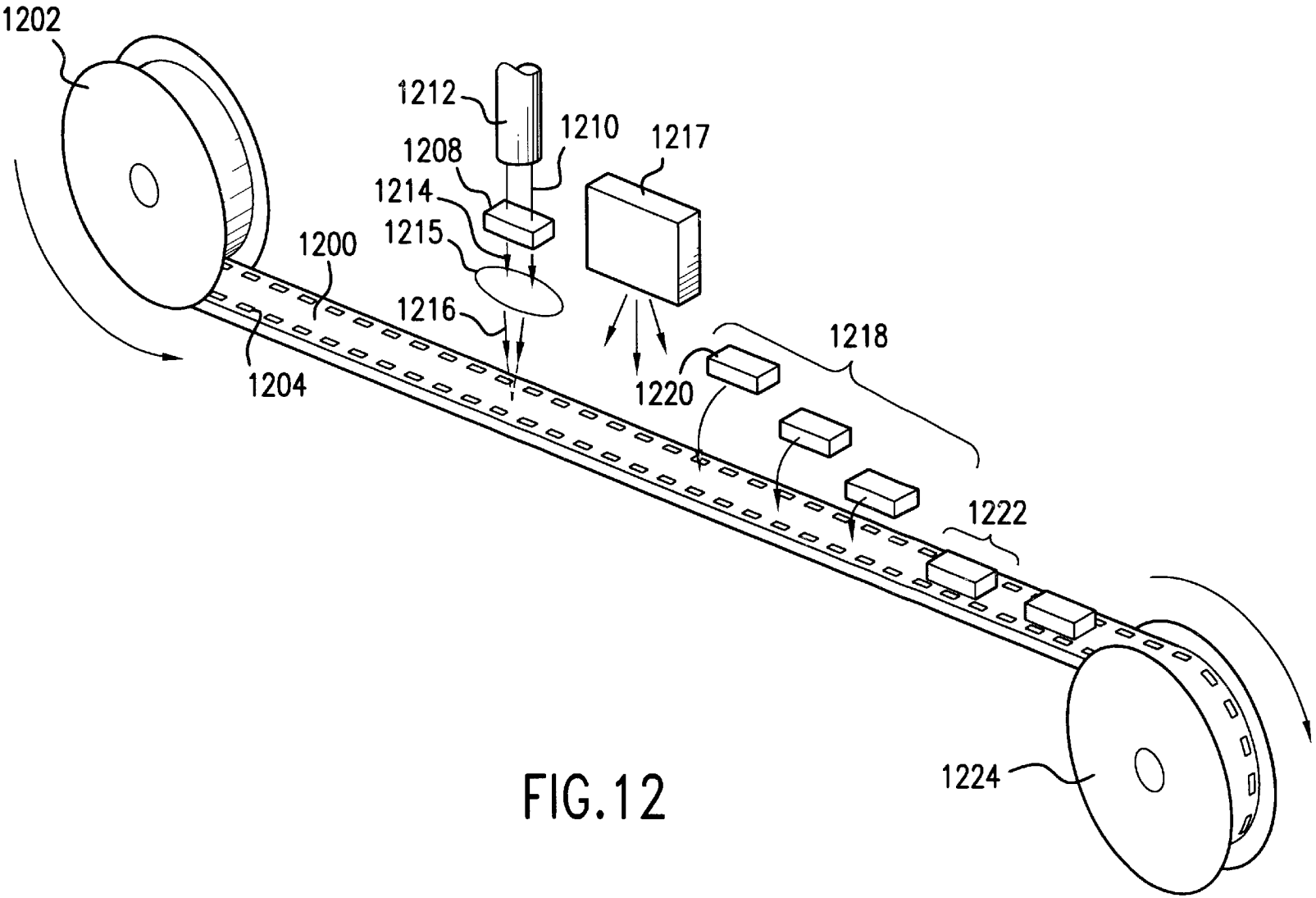
FIG. 12 illustrates one step of one process that may be used to form the preferred TAB head assembly.
Figure 13:
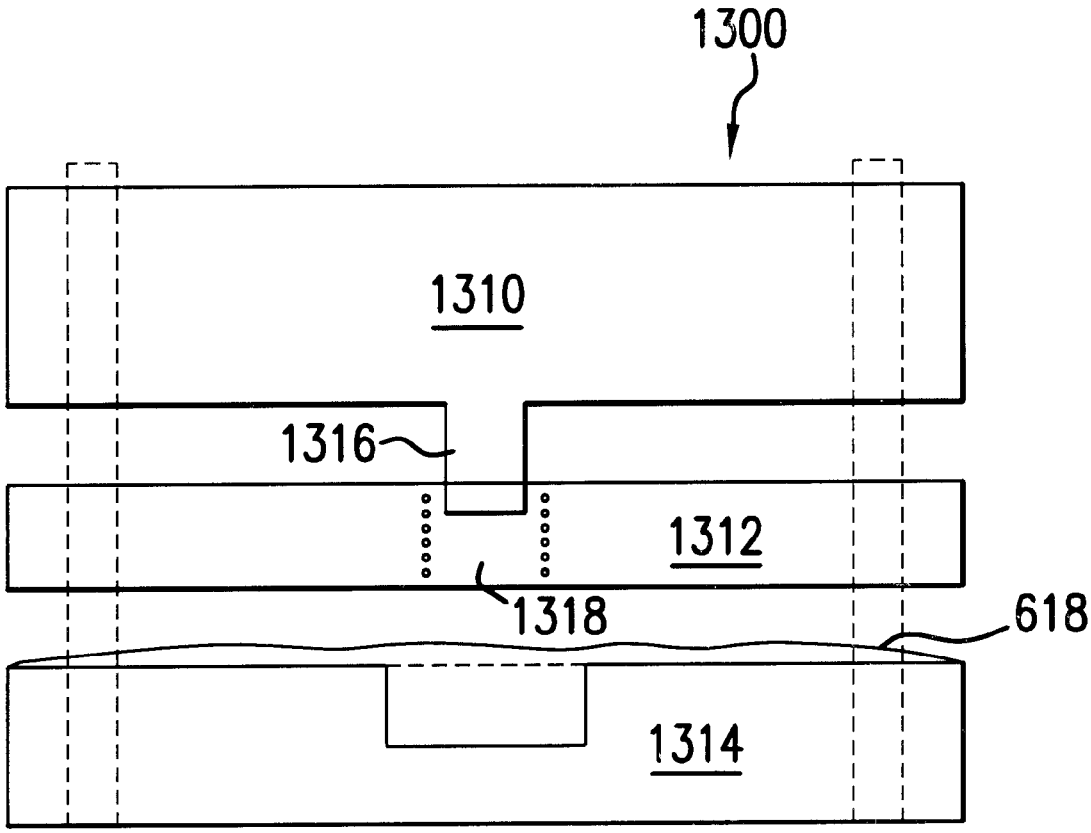
FIG. 13 illustrates the preferred process to form the reinforcing features of the TAB head assembly.

The orifices 617 and conductive traces 636 may be of any size, number, and pattern, and the various figures are designed to simply and clearly show the features of the invention. The relative dimensions of the various features have been greatly adjusted for the sake of clarity. The orifice 617 pattern on the flexible circuit 618 shown in FIG. 7 may be formed by a masking process in combination with a laser or other etching means in a step-and-repeat process, which would be readily understood by one of ordinary skilled in the art after reading this disclosure. FIGS. 12–13, to be described in detail later, provides additional details of this process. Further details regarding TAB head assembly 614 and flexible circuit 618 are provided below.

Reinforcing Features of Flexible Circuit

Also, the flexible circuit 618 includes reinforcing features 640 (shown in detail in FIGS. 10 and 11 below). These features 640 increase the structural integrity of flex in the vicinity of the orifices 617. The reinforcing features 640 can be of any suitable shape for increasing the stiffness and reducing the long axis curvature of the flex material in the vicinity of the orifices 617 during preprocessing of the flexible circuit 618 (discussed in detail below). As a result, mechanical properties of the flexible circuit 618 are improved without additional materials or coatings.

Figure 9:
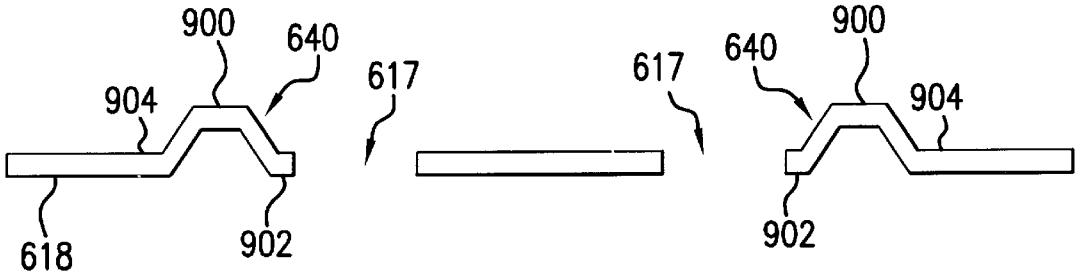
FIG. 9 is a detailed cross-sectional view taken along line B—B of FIG. 8 showing the details of the reinforcing features of the TAB head assembly.

FIG. 9 is a detailed cross-sectional exploded view of the flex circuit taken along line B—B of FIG. 8 showing the details of one set of reinforcing features of the TAB head assembly. Unwanted dimpling, often referred to as "macro dimple", is usually formed in the flex circuit 618 of TAB head assembly 614 by the bending or deformation of the flex circuit 618 due to the stresses created by the adhesive process of sealing the nozzle member 616 to the print cartridge 10. This dimpling of the nozzle member 616 creates nozzles 617 that are skewed causing trajectory errors for the ejected ink droplets from the nozzle. When the TAB head assembly 614 is scanned across a recording medium the ink trajectory errors will affect the location of printed dots and thus the quality of printing. The reinforcing features 640 of the present invention reduce the "macro dimple" and therefore improve print quality.

The reinforcing features 640 of the flex circuit 618 can be deemed by any suitable feature that provides increased stiffness to the flex circuit in the vicinity of the orifices 617. For example, the reinforcing features can be defined by protruding ridges 900 with inside 902 and outside 904 bases in the area near the orifices 617 as shown in FIG. 9. FIG. 9 shows the reinforcing features 640 with a "mesa" cross sectional shape, however, any suitable shape/geometry can be used, such as a "U" or similar arcuate shape, "V" pointed shape, square shape, regular or irregular shape, etc. The reinforcing features 640 provide increased stiffness to the flex circuit 618 in the vicinity of the orifices 617, as compared with the original flat shape of the flex circuit 618. As a result, the flex circuit 618, in the vicinity of the orifices 617, is more resistant to deformation throughout THA and pen processing.

The additional resistance to deformation of the flex circuit 618 in the vicinity of the orifices 617 increases NCA precision and reduces dimple in the nozzle member and the attendant nozzle trajectory errors. In addition, the reinforcing features 640 reduces drop ejection directionality variation, resulting in improved print quality. Also, eaves height variation is reduced, resulting in improved frequency response and throughput performance. Further, several advantages of the present invention include no need for added parts or materials, no new material compatibility issues with ink, adhesive, etc., increased structural integrity of flex in the vicinity of the orifices and process tooling is simpler than in other prior solutions.

Figure 10:
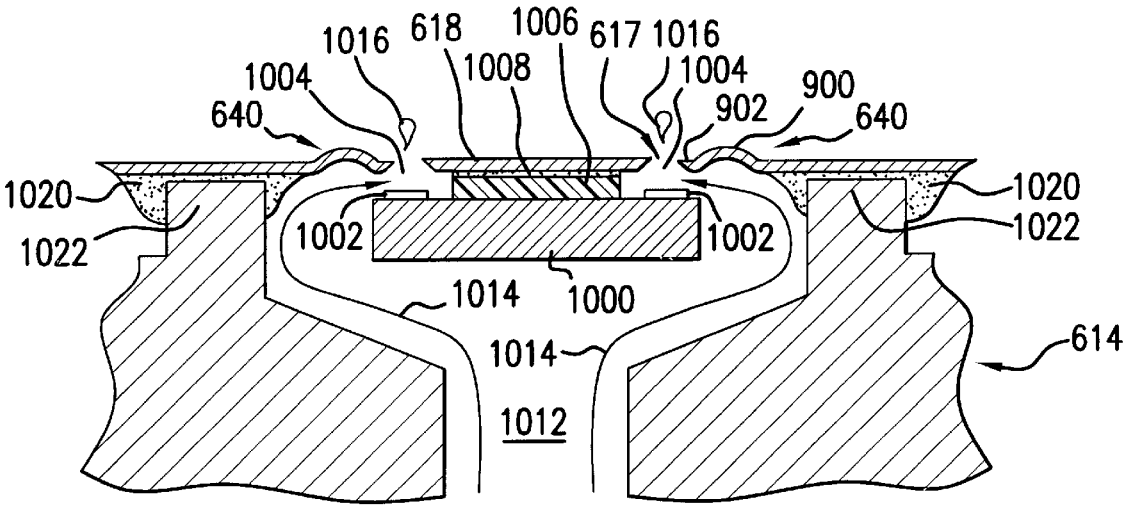
FIG. 10 is a schematic cross-sectional view taken along line B—B of FIG. 8 showing the reinforcing features of the TAB head assembly as well as the ink flow path around the edges of the substrate.

FIG. 10 is a schematic cross-sectional view taken along line B—B of FIG. 8 showing the reinforcing features of the TAB head assembly as well as the ink flow path around the edges of the substrate. A silicon substrate 1000 is affixed to the back of the flexible circuit 618 of FIG. 8. Silicon substrate 1000 has formed on it, preferably using conventional photolithographic techniques, thin film resistors 1002, such as two rows or columns of thin film resistors, exposed through vaporization chambers 1004 formed in a barrier layer 1006 of substrate 1000. The inside base 902 of the protruding ridge 900 of FIG. 9 of the reinforcing features 640 is preferably located in relatively close proximity to the orifice 617, without affecting ink mobility through the orifice 617.

In one embodiment, the reinforcing features 640 have a height within a range of approximately 0.0005 inches to 0.008 inches and a width with a range of approximately 0.003 inches to 0.030 inches. The substrate 1000 is approximately one-half inch long and contains 300 heater resistors 1002, thus enabling a resolution of 600 dots per inch. Heater resistors 1002 may instead be any other type of ink ejection element, such as a piezoelectric pump-type element or any other conventional element. Thus, element 1002 in all the various figures may be considered to be piezoelectric elements in an alternative embodiment without affecting the operation of the printhead. Also, the substrate 1000 has electrodes (not shown) formed on the back of the flexible circuit 618 for connection to the conductive traces 636 of FIG. 7.

A demultiplexer (not shown), is also formed on the substrate 1000 for demultiplexing the incoming multiplexed signals applied to the electrodes and distributing the signals to the various thin film resistors 1002. The demultiplexer enables the use of much fewer electrodes than thin film resistors 1002. Having fewer electrodes allows all connections to the substrate to be made from the short end portions of the substrate, so that these connections will not interfere with the ink flow around the long sides of the substrate. The demultiplexer may be any decoder for decoding encoded signals applied to the electrodes. The demultiplexer has input leads (not shown for simplicity) connected to the electrodes and has output leads (not shown) connected to the various resistors 1002.

The barrier layer 1006 is formed on the surface of the substrate 1000 using conventional photolithographic techniques, and can be a layer of photoresist or some other polymer, which is formed near the vaporization chambers 1004. A portion of the barrier layer 1006 insulates the conductive traces 636 from the underlying substrate 1000. A top surface of the barrier layer 1006 is heat bonded to a back surface of the flexible circuit 618. The resulting substrate structure is then positioned with respect to the back surface of the flexible circuit 618 so as to align the resistors 1002 with the orifices formed in the flexible circuit 618. This alignment step also inherently aligns the electrodes with the ends of the conductive traces 636. The traces 636 are then bonded to the electrodes. The aligned and bonded substrate/flexible circuit structure is then heated while applying pressure to and firmly affix the substrate structure to the back surface of the flexible circuit 618.

The substrate 1000, via the barrier layer 1006, is secured to the back of the flexible circuit 618 with a thin adhesive layer 1008. In operation, ink flows from an ink reservoir 1012 around a side edge of the substrate 1000, and into an ink channel of an associated vaporization chamber 1004, as shown by arrow 1014. Upon energization of the thin film resistor 1002, a thin layer of the adjacent ink is superheated, causing explosive vaporization and, consequently, causing a droplet of ink 1016 to be ejected through the orifice 617. The vaporization chamber 1004 is then refilled by capillary action. Also, an adhesive seal 1020 is applied to an inner raised wall 1022 and wall openings surrounding the substrate 1000. In a preferred embodiment, the barrier layer 1006 is approximately 1 mils thick, the substrate 1000 is approximately 20 mils thick, and the flexible circuit 618 is approximately 2 mils thick.

Figure 11:
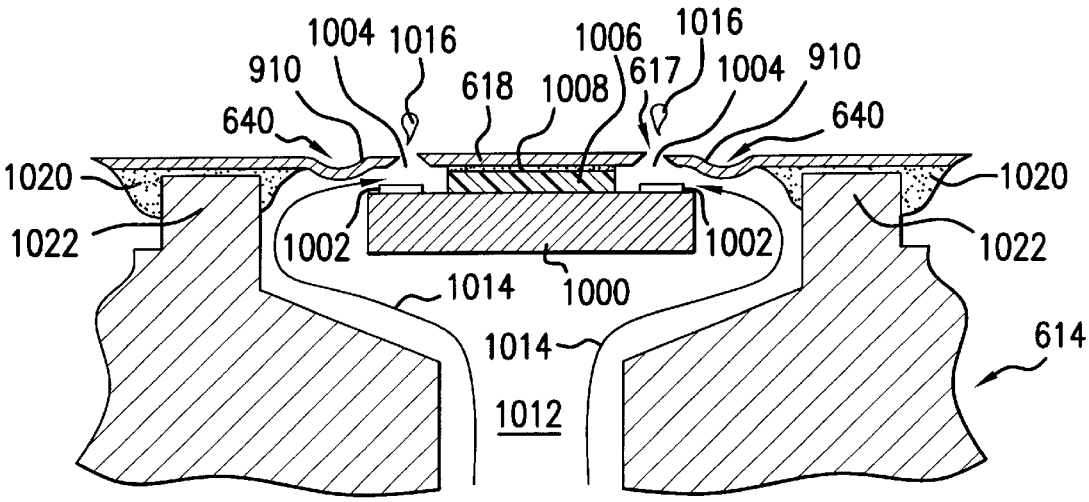
FIG. 11 is a schematic cross-sectional view taken along line B—B of FIG. 8 showing an alternative embodiment of the reinforcing features of the TAB head assembly as well as the ink flow path around the edges of the substrate.

FIG. 11 is a schematic cross-sectional view taken along line B—B of FIG. 8 showing an alternative embodiment of the reinforcing features of the TAB head assembly as well as the ink flow path around the edges of the substrate. As shown in FIG. 11, one or more reinforcing features can be defined by a recessed valley 910 located within the chamber area 1004. However, it should be noted that the recessed valley 910 is arranged so that enough gap space exists within the chamber 1004 to allow ink to flow out of the orifice 617.

Flex Circuit Processing

FIG. 12 illustrates one method for forming the preferred embodiment of the TAB head assembly 614. The starting material is a Kapton™ or Upilex™ type polymer tape 1200, although the tape 1200 can be any suitable polymer film which is acceptable for use in the below-described procedure. Some such films may comprise Teflon, polyamide, polymethylmethacrylate, polycarbonate, polyester, polyamide polyethylene-terephthalate or mixtures thereof. The tape 1200 is typically provided in long strips on a reel 1202. Sprocket holes 1204 along the sides of the tape 1200 are used to accurately and securely transport the tape 1200. Alternately, the sprocket holes 1204 may be omitted and the tape may be transported with other types of fixtures. In the preferred embodiment, the tape 1200 is already provided with conductive copper traces 636, such as shown in FIG. 7, formed thereon using conventional metal deposition and photolithographic processes. The particular pattern of conductive traces depends on the manner in which it is desired to distribute electrical signals to the electrodes formed on silicon dies, which are subsequently mounted on the tape 1200.

In the preferred process, the tape 1200 is transported to a laser processing chamber and laser-ablated in a pattern defined by one or more masks 1208 using laser radiation 1210, such as that generated by an Excimer laser 1212 of the $F_2$, ArF, KrCl, KrF, or XeCl type. The masked laser radiation is designated by arrows 1214.

In a preferred embodiment, such masks 1208 define all of the ablated features for an extended area of the tape 1200, for example encompassing multiple orifices in the case of an orifice pattern mask 1208, and multiple vaporization chambers in the case of a vaporization chamber pattern mask 1208. Alternatively, patterns such as the orifice pattern, the vaporization chamber pattern, or other patterns may be placed side by side on a common mask substrate which is substantially larger than the laser beam. Then such patterns may be moved sequentially into the beam. The masking material used in such masks will preferably be highly reflecting at the laser wavelength, consisting of, for example, a multi-layer dielectric or a metal such as aluminum.

In one embodiment, a separate mask 1208 defines the pattern of windows 622 and 624 shown in FIG. 6. However, in the preferred embodiment, the windows 622 and 624 are formed using conventional photolithographic methods prior to the tape 1200 being subjected to other processes.

In an alternative embodiment of a nozzle member, where the nozzle member also includes vaporization chambers, one or more masks 1208 would be used to form the orifices and another mask 1208 and laser energy level (and/or number of laser shots) would be used to define the vaporization chambers, ink channels, and manifolds which are formed through a portion of the thickness of the tape 1200.

The laser system for this process generally includes beam delivery optics, alignment optics, a high precision and high speed mask shuttle system, and a processing chamber including a mechanism for handling and positioning the tape 1200. In the preferred embodiment, the laser system uses a projection mask configuration wherein a precision lens 1215 interposed between the mask 1208 and the tape 1200 projects the Excimer laser light onto the tape 1200 in the image of the pattern defined on the mask 1208.

The masked laser radiation exiting from lens 1215 is represented by arrows 1216. Such a projection mask configuration is advantageous for high precision orifice dimensioning, because the mask is physically remote from the nozzle member. Soot is naturally formed and ejected in the ablation process, traveling distances of about one centimeter from the nozzle member being ablated. If the mask were in contact with the nozzle member, or in proximity to it, soot buildup on the mask would tend to distort ablated features and reduce their dimensional accuracy. In the preferred embodiment, the projection lens is more than two centimeters from the nozzle member being ablated, thereby avoiding the buildup of any soot on it or on the mask.

Ablation is well known to produce features with tapered walls, tapered so that the diameter of an orifice is larger at the surface onto which the laser is incident, and smaller at the exit surface. The taper angle varies significantly with variations in the optical energy density incident on the nozzle member for energy densities less than about two joules per square centimeter. If the energy density were uncontrolled, the orifices produced would vary significantly in taper angle, resulting in substantial variations in exit orifice diameter. Such variations would produce deleterious variations in ejected ink drop volume and velocity, reducing print quality. In the preferred embodiment, the optical energy of the ablating laser beam is precisely monitored and controlled to achieve a consistent taper angle, and thereby a reproducible exit diameter. In addition to the print quality benefits resulting from the constant orifice exit diameter, a taper is beneficial to the operation of the orifices, since the taper acts to increase the discharge speed and provide a more focused ejection of ink, as well as provide other advantages.

The taper may be in the range of 5 to 15 degrees relative to the axis of the orifice. The preferred embodiment process described herein allows rapid and precise fabrication without a need to rock the laser beam relative to the nozzle member. It produces accurate exit diameters even though the laser beam is incident on the entrance surface rather than the exit surface of the nozzle member.

After the step of laser-ablation, the polymer tape 1200 is stepped, and the process is repeated. This is referred to as a step-and-repeat process. The total processing time required for forming a single pattern on the tape 1200 may be on the order of a few seconds. As mentioned above, a single mask pattern may encompass an extended group of ablated features to reduce the processing time per nozzle member.

Laser ablation processes have distinct advantages over other forms of laser drilling for the formation of precision orifices, vaporization chambers, and ink channels. In laser ablation, short pulses of intense ultraviolet light are absorbed in a thin surface layer of material within about 1 micrometer or less of the surface. Preferred pulse energies are greater than about 100 milli-joules per square centimeter and pulse durations are shorter than about 1 microsecond. Under these conditions, the intense ultraviolet light photodissociates the chemical bonds in the material. Furthermore, the absorbed ultraviolet energy is concentrated in such a small volume of material that it rapidly heats the dissociated fragments and ejects them away from the surface of the material. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micrometer. In addition, laser ablation can also form chambers with substantially flat bottom surfaces which form a plane recessed into the layer, provided the optical energy density is constant across the region being ablated. The depth of such chambers is determined by the number of laser shots, and the power density of each.

Laser-ablation processes also have numerous advantages as compared to conventional lithographic electroforming processes for forming nozzle members for inkjet printheads. For example, laser-ablation processes generally are less expensive and simpler than conventional lithographic electroforming processes. In addition, by using laser-ablations processes, polymer nozzle members can be fabricated in substantially larger sizes (i.e., having greater surface areas) and with nozzle geometries that are not practical with conventional electroforming processes. In particular, unique nozzle shapes can be produced by controlling exposure intensity or making multiple exposures with a laser beam being reoriented between each exposure. Examples of a variety of nozzle shapes are described in co-pending application Ser. No. 07/658726, entitled "A Process of Photo-Ablating at Least One Stepped Opening Extending Through a Polymer Material, and a Nozzle Plate Having Stepped Openings," assigned to the present assignee and incorporated herein by reference. Also, precise nozzle geometries can be formed without process controls as strict as those required for electroforming processes.

Another advantage of forming nozzle members by laser-ablating a polymer material is that the orifices or nozzles can be easily fabricated with various ratios of nozzle length (L) to nozzle diameter (D). In the preferred embodiment, the L/D ratio exceeds unity. One advantage of extending a nozzle's length relative to its diameter is that orifice-resistor positioning in a vaporization chamber becomes less critical.

In use, laser-ablated polymer nozzle members for inkjet printers have characteristics that are superior to conventional electroformed orifice plates. For example, laser-ablated polymer nozzle members are highly resistant to corrosion by water-based printing inks and are generally hydrophobic. Further, laser-ablated polymer nozzle members have a relatively low elastic modules, so built-in stress between the nozzle member and an underlying substrate or barrier layer has less of a tendency to cause nozzle member-to-barrier layer de-lamination. Still further, laser-ablated polymer nozzle members can be readily fixed to, or formed with, a polymer substrate.

Although an Excimer laser is used in the preferred embodiments, other ultraviolet light sources with substantially the same optical wavelength and energy density may be used to accomplish the ablation process. Preferably, the wavelength of such an ultraviolet light source will lie in the 150 nm to 400 nm range to allow high absorption in the tape to be ablated. Furthermore, the energy density should be greater than about 100 milijoules per square centimeter with a pulse length shorter than about 1 microsecond to achieve rapid ejection of ablated material with essentially no heating of the surrounding remaining material.

As will be understood by those of ordinary skill in the art, numerous other processes for forming a pattern on the tape 1200 may also be used. Other such processes include chemical etching, stamping, reactive ion etching, ion beam milling, and molding or casting on a photodefined pattern.

A next step in the process is a cleaning step wherein the laser ablated portion of the tape 1200 is positioned under a cleaning station 1217. At the cleaning station 1217, debris from the laser ablation is removed according to standard industry practice.

The tape 1200 is then stepped to the next station, which is an optical alignment station 1218 incorporated in a conventional automatic TAB bonder, such as an inner lead bonder commercially available from Shinkawa Corporation, model number IL-20. The bonder is preprogrammed with an alignment (target) pattern on the nozzle member, created in the same manner and/or step as used to created the orifices, and a target pattern on the substrate, created in the same manner and/or step used to create the resistors. In the preferred embodiment, the nozzle member material is semi-transparent so that the target pattern on the substrate may be viewed through the nozzle member. The bonder then automatically positions the silicon dies 1220 with respect to the nozzle members so as to align the two target patterns. Such an alignment feature exists in the Shinkawa TAB bonder. This automatic alignment of the nozzle member target pattern with the substrate target pattern not only precisely aligns the orifices with the resistors but also inherently aligns the electrodes on the dies 1220 with the ends of the conductive traces formed in the tape 1200, since the traces and the orifices are aligned in the tape 1200, and the substrate electrodes and the heating resistors are aligned on the substrate. Therefore, all patterns on the tape 1200 and on the silicon dies 1220 will be aligned with respect to one another once the two target patterns are aligned.

Thus, the alignment of the silicon dies 1220 with respect to the tape 1200 is performed automatically using only commercially available equipment. By integrating the conductive traces with the nozzle member, such an alignment feature is possible. Such integration not only reduces the assembly cost of the printhead but reduces the printhead material cost as well.

The automatic TAB bonder then uses a gang bonding method to press the ends of the conductive traces down onto the associated substrate electrodes through the windows formed in the tape 1200. The bonder then applies heat, such as by using thermo-compression bonding, to weld the ends of the traces to the associated electrodes. A schematic side view of one embodiment of the resulting structure is shown in FIG. 7, Other types of bonding can also be used, such as ultrasonic bonding, conductive epoxy, solder paste, or other well-known means.

The tape 1200 is then stepped to a heat and pressure station 1222 and the silicon dies 1220 are then pressed down against the tape 1200, and heat is applied to physically bond the dies 1220 to the tape 1200.

Thereafter the tape 1200 steps and is optionally taken up on the take-up reel 1224. The tape 1200 may then later be cut to separate the individual TAB head assemblies from one another.

The resulting TAB head assembly is then positioned on the print cartridge 600 of FIG. 6, and the previously described adhesive seal 1008 of FIG. 10 is formed to firmly secure the nozzle member to the print cartridge, provide an ink-proof seal around the substrate between the nozzle member and the ink reservoir, and encapsulate the traces in the vicinity of the headland so as to isolate the traces from the ink.

Peripheral points on the flexible TAB head assembly are then secured to the plastic print cartridge 600 by a conventional melt-through type bonding process to cause the polymer flexible circuit 618 to remain relatively flush with the surface of the print cartridge 600, as shown in FIG. 10. Creation of the reinforcing features 640 can be performed at any suitable convenient time during the above process, as described below.

FIG. 13 illustrates the preferred process to form the reinforcing features of the TAB head assembly. The invention further includes a method for creating the reinforcing features by selectively embossing the flex circuit 618 either before, after, or during the creation of the orifices of the nozzle member, such as with the laser ablation process described above. An embossing tool 1300 includes a punch or rib plate 1310, a stripper plate 1312 and a die or slot plate 1314. One heating device (not shown) or individual heating devices (not shown) can be coupled to each of the punch plate 1310, stripper plate 1312, and die plate 1314.

In operation, the flex circuit 618 is located between the stripper plate 1312 and the die plate 1314. The punch plate 1310 includes an embossing (punch) blade 1316 aligned with a receiving slot 1318 of the stripper plate 1312. As the flex circuit 618 is located between the stripper plate 1312 and the die plate 1314, the punch plate 1310, stripper plate 1312 and the die plate 1314 converge in any suitable manner. This could include having the die plate 1314 and the stripper plate 1312 being stationary and having the punch plate 1310 move toward the die plate 1314. As the punch plate 1310 converges with the die plate 1314, the embossing blade 1316 of the punch plate contacts the flex circuit 618 and permanently plastically deforms the flex circuit 618. A feature is created on the flex circuit 618 defined by the configuration of the embossing blade 1316, punch plate 1310, stripper plate 1312 and die plate die plate 1314.

The variables that affect the quality of the reinforcing features include the compression temperature/time/force profiles for the punch, stripper and die plates 1310, 1312, 1314. Also, the thickness, depth, width and clearance of the embossing blade 1316 affect the quality of the reinforcing features. In addition, the surface finish of the forming edges of the punch and die plates 1310, 1314 and the alignment error of the punch and die plates 1310. 1314 affect the quality of the reinforcing features.

WORKING EXAMPLE

This section illustrates one working example of creating the reinforcing features. First, punch penetration depth is set at a predefined limit and verified. For example, the punch penetration depth can be set at −0.006". The tool 1300 of FIG. 13 can include an adjustable hard stop device (not shown) for precision control of the amount of penetration of the punch blades 1316 into the flex circuit 618. In one example, the adjustment resolution is 0.003". Adjustments from −0.006" to 0.000" can be used. Preferably an adjustment of −0.006" is used. It should be noted that calibration at high temperatures were not used for the above penetration depths. It is expected that some offset would occur from the thermal expansion of the tool.

Second, if individual heating devices are utilized, each heating device for the punch, stripper and die plates 1310, 1312, 1314 are activated. The three temperatures can be the same or different. Temperatures can range from 150° C.–250° C., but preferably all three heating devices are set to 250° C. In addition, temperature range enhancements can be employed by adding cooling mechanism, such as a liquid Nitrogen or coolant recycler for "cold" embossing below room temperature, or rapid cooling to "freeze" in the emboss.

Third, the flex circuit 618 is inserted into the work area, between the die plate 1314 and the stripper plate 1312. Tooling holes of the flex circuit 618 are aligned onto alignment pins on the die plate 1314. Proper seating of the flex circuit 618 is then verified.

Fourth, downward motion of the stripper plate 1312 is activated with low force. Once the stripper plate 1312 is seated onto the flex circuit 618, the low force is held for a preset "stripper force" dwell time. Next, the punch plate 1310 is gradually lowered onto the flex circuit, with incremental embossing forces applied until a full embossing force is applied. The full embossing force is held for a preset "emboss force" dwell time.

Stripper force dwell times preferably range from 30 to 120 seconds. An initial stripper plate cylinder pressure of 20 psi is preferably used, which corresponds to approximately the same pressure at the flex circuit 618. Emboss force dwell times preferably range from 15 to 60 seconds. The full embossing force is preferably set at a cylinder pressure of 70 psi, which again corresponds to approximately the same pressure at the flex circuit 618. Also, a preheat step at minimal force of the flex circuit 618, which is eventually heated to the process temperature, can be employed. This allows the flex circuit 618 to expand freely, and aids in achieving thermal equilibrium in the flex circuit 618.

Fifth, all forces are released and the punch 1310 and stripper 1312 and plates are lifted. The flex circuit 618 is indexed to the next area or pitch to be embossed and the third through fifth steps are repeated until the desired number of reinforcing features are created.

Figure 14:
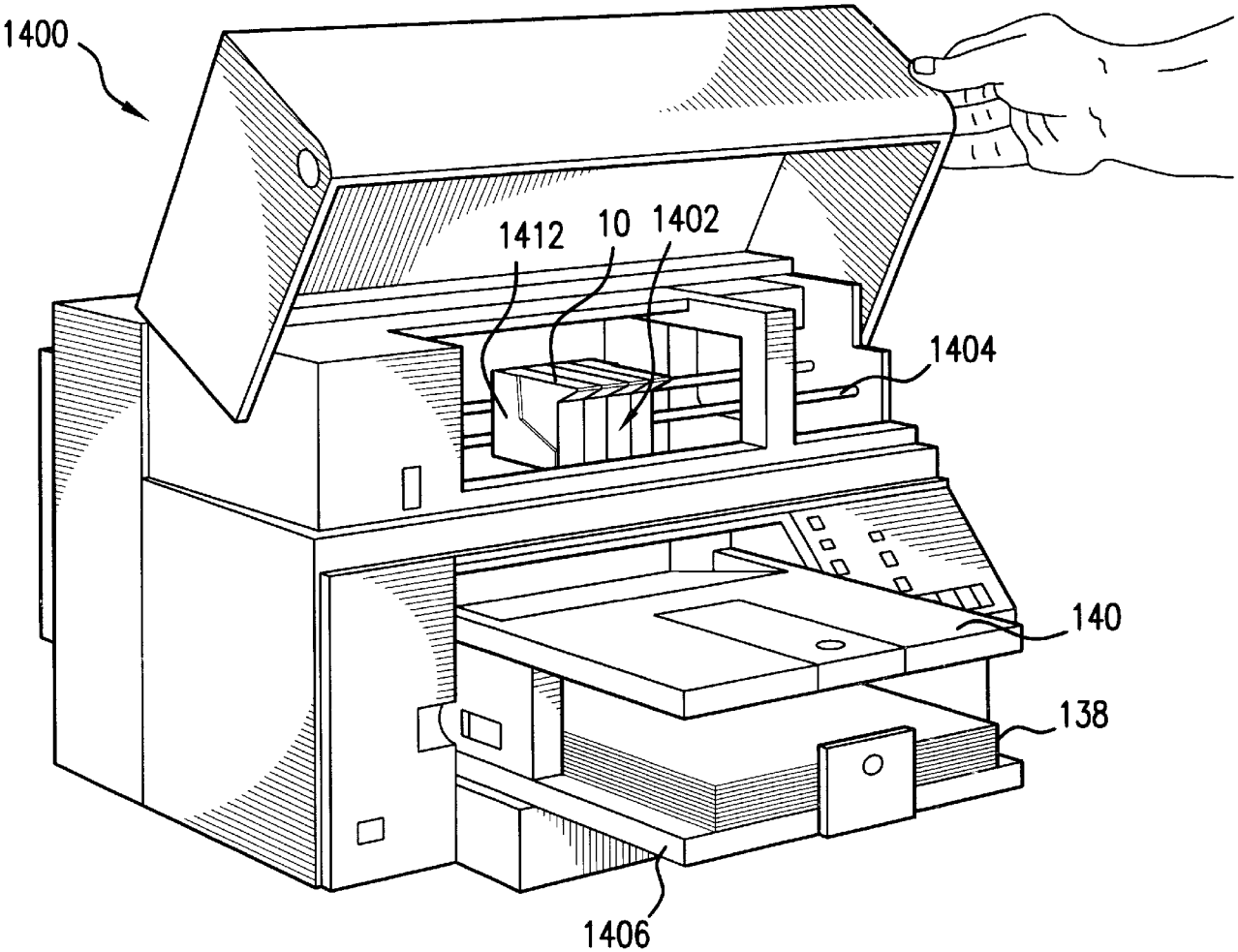
FIG. 14 is a perspective view showing a inkjet printer incorporating the present invention.

FIG. 14 shows a color inkjet printer 1400 incorporating the present invention. In particular, inkjet printer 1400 includes a movable carriage assembly 1402 supported on slider rod 1404 at the rear and a slider bar (not shown) at the front. The slider rod 1404 at the rear and a slider bar (not shown) at the front are mounted to the frame (not shown) of printer 1400. Inkjet printer 1400 also is provided with input tray 1406 containing a number of sheets of paper or other suitable ink receiving medium 1408, and an upper output tray 1410 for receiving the printed media. The movable carriage 1402 includes a single or a plurality of individual cartridge receptacles 1412 for receiving a respective number of removable print cartridges 600.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A reinforced circuit comprising:

a flexible polymer film having conductive traces formed thereon and defined by a transverse axis and a longitudinal axis; and wherein the film includes a designated area of interest including at least one nozzle with a nozzle camber angle and at least one reinforcing feature located adjacent to the nozzle to provide increased stiffness near the designated area of interest, reduce the longitudinal axis curvature of the flexible polymer film and to control the nozzle camber angle in the designated area of interest for biasing ink drop trajectory.

2. The reinforced circuit of claim 1, wherein the reinforcing feature is defined by a protruding ridge.

3. The reinforced circuit of claim 1, wherein the reinforcing feature is defined by a recessed valley.

4. The reinforced circuit of claim 1, wherein the reinforcing feature is defined by an arcuate cross sectional shape.

5. The reinforced circuit of claim 1, wherein the reinforcing feature is defined by a triangular cross sectional shape.

6. The reinforced circuit of claim 1, wherein the reinforcing feature is defined by a trapezoidal cross sectional shape.

7. The reinforced circuit of claim 1, wherein the reinforcing feature has a width within a range of 0.375 to 10 times greater than the height.

8. The reinforced circuit of claim 1, wherein the reinforcing feature has a height within a range of approximately 0.0005 inches to 0.008 inches and a width with a range of approximately 0.003 inches to 0.030 inches.

9. A print cartridge for an inkjet printer comprising:

a nozzle member comprising a flexible circuit having plural ink orifices formed along a longitudinal axis;

a substrate mounted on a back surface of the nozzle member and containing plural ink ejection chambers being located proximate to an associated ink orifice for allowing ink to travel from the ink ejection chambers and through associated orifices; and plural reinforcing features located proximate to associated ink orifices and having at least one protruding ridge extending above an associated ink ejection chamber without affecting ink mobility through an associated orifice, wherein the plural reinforcing features provide increased stiffness near the respective associated ink orifice and reduce the longitudinal axis curvature of the flexible circuit.

10. The print cartridge of claim 9, wherein each reinforcing feature is defined by a protruding ridge.

11. The print cartridge of claim 9, wherein each reinforcing feature is defined by a recessed valley.

12. The print cartridge of claim 11, wherein at least one recessed valley extends within an associated ink ejection chamber without affecting ink mobility through an associated orifice.

13. The print cartridge of claim 9, wherein at least one reinforcing feature is defined by an arcuate cross sectional shape.

14. The print cartridge of claim 9, wherein at least one reinforcing feature is defined by a triangular cross sectional shape.

15. The print cartridge of claim 9, wherein at least one reinforcing feature is defined by a trapezoidal cross sectional shape.

16. The print cartridge of claim 9, wherein at least one reinforcing feature has a width within a range of 1 to 6 times greater than a height.

17. The print cartridge of claim 9, wherein at least one reinforcing feature has a height within a range of approximately 0.0005 inches to 0.008 inches and a width with a range of approximately 0.003 inches to 0.030 inches.

* * * * *